US009777555B2

(12) United States Patent
Donzier

(10) Patent No.: US 9,777,555 B2
(45) Date of Patent: Oct. 3, 2017

(54) PREDICTIVE FLOW ASSURANCE ASSESSMENT METHOD AND SYSTEM

(71) Applicant: OPENFIELD, Versailles (FR)

(72) Inventor: Eric Donzier, Berchères sur Vesgre (FR)

(73) Assignee: OPENFIELD, Versailles (FR)

( * ) Notice: Subject to any disclaimer, the term of this patent is extended or adjusted under 35 U.S.C. 154(b) by 371 days.

(21) Appl. No.: 14/410,043

(22) PCT Filed: Jun. 21, 2013

(86) PCT No.: PCT/EP2013/063000
§ 371 (c)(1),
(2) Date: Dec. 19, 2014

(87) PCT Pub. No.: WO2013/190093
PCT Pub. Date: Dec. 27, 2013

(65) Prior Publication Data

US 2016/0186533 A1 Jun. 30, 2016

(30) Foreign Application Priority Data

Jun. 22, 2012 (EP) ..... 12305731

(51) Int. Cl.
*G01V 1/40* (2006.01)
*G01V 3/00* (2006.01)
(Continued)

(52) U.S. Cl.
CPC ..... *E21B 41/02* (2013.01); *E21B 37/06* (2013.01); *E21B 43/01* (2013.01); *E21B 49/08* (2013.01)

(58) Field of Classification Search
CPC ..... E21B 37/06; E21B 49/08; E21B 43/01; E21B 41/02; E21B 41/04; E21B 49/086;
(Continued)

(56) References Cited

U.S. PATENT DOCUMENTS 5,016,712 A 5/1991 Cullick
5,937,894 A 8/1999 Rojey
(Continued)

FOREIGN PATENT DOCUMENTS

SU 1308995 A1 5/1987

OTHER PUBLICATIONS

PCT/EP2013/063000 International Search Report, dated Apr. 9, 2014, European Patent Office, P.B. 5818 Patentlaan 2 NL—2280 HV Rijswijk.
(Continued)

*Primary Examiner* — An Do
(74) *Attorney, Agent, or Firm* — The Jansson Firm; Pehr B. Jansson

(57) ABSTRACT

A system and method for predictive flow assurance assessment by measuring at least one actual parameter related to a multiphase fluid mixture flowing in a main flow line, taking a sample from the multiphase fluid mixture flowing in the main flow line, modifying at least one control parameter of the sample until a transition appears, wherein said transition would cause a flow issue when occurring in the main flow line, detecting the transition of the sample and determining a corresponding transition value associated with the at least one control parameter, calculating a difference between the at least one actual parameter and the at least one transition value, said difference being representative of a margin relatively to a similar transition appearance in the main flow line causing a flow issue in the main flow line, and implementing a flow issue preventing step when the difference exceeds a given threshold.

13 Claims, 3 Drawing Sheets

(51) Int. Cl.

| | |
|---|---|
| ***E21B 41/02*** | (2006.01) |
| ***E21B 37/06*** | (2006.01) |
| ***E21B 43/01*** | (2006.01) |
| ***E21B 49/08*** | (2006.01) |

(58) Field of Classification Search
CPC ..... E21B 49/081; E21B 47/10; G01N 11/00; G01N 9/00; G01F 1/74
USPC ..... 702/2, 6
See application file for complete search history.

(56) References Cited

U.S. PATENT DOCUMENTS

| | | | |
|---|---|---|---|
| 2010/0059221 | A1 | 3/2010 | Vannuffelen |
| 2011/0040501 | A1 | 2/2011 | Martin et al. |

OTHER PUBLICATIONS

PCT/EP2013/063000 Written Opinion of the International Searching Authority, dated Apr. 9, 2014, European Patent Office, P.B. 5818 Patentlaan 2 NL—2280 HV Rijswijk.

PREDICTIVE FLOW ASSURANCE ASSESSMENT METHOD AND SYSTEM

TECHNICAL FIELD

An aspect of the invention relates to a predictive flow assurance assessment method. The invention further relates to a predictive flow assurance assessment system. Such a predictive flow assurance assessment method and system find a particular, though non exclusive, application in the field of exploitation of oilfield reservoirs in harsh environment comprising low temperature conditions, or important variation of temperature and/or pressure in different parts of an oilfield production installation. Such harsh environments may be found with respect to oilfield exploitation applications in arctic region, in deep sea zone, etc. . . .

BACKGROUND OF THE INVENTION

The document U.S. Pat. No. 5,937,894 describes a method for producing and/or transporting by pipeline, from a location such as a reservoir to a point of destination, a multi-phase fluid susceptible to the formation of hydrates under given thermodynamic conditions. During production and/or transportation, at least one relationship is determined between at least two physical parameters associated with hydrate formation, such as the pressure P, the temperature T and/or a parameter associated with the composition of the fluid or the composition of the fluid itself, the said relationship defining at least one range within which hydrates form. At least one of the physical parameters is measured and, using the relationship and/or the established formation range and a processing and control device, at least one of the physical parameters is adjusted in order to bring and/or maintain the fluid outside the hydrate formation range.

The document SU 1 308 995 describes a device for introducing hydrate generation inhibitor in gas flow.

The document US 2010/059221 describes a subsea apparatus and a method for sampling and analysing fluid from a subsea fluid flowline proximate a subsea well, wherein the apparatus comprises at least one housing located in close proximity to said subsea fluid flowline; at least one fluid sampling device located in the housing in fluid communication with a said subsea fluid flowline for obtaining a sample of fluid from the subsea fluid flowline; at least one fluid processing apparatus located in the housing in fluid communication with said subsea fluid flowline for receiving and processing a portion of the fluid flowing through said fluid flowline or in fluid communication with the fluid sampling device, for processing the sample of fluid obtained from the subsea fluid flowline for analysis, while keeping the sample of fluid at subsea conditions; a fluid analysis device located in the housing, the fluid analysis device being in fluid communication with the fluid processing device and/or with the fluid sampling device, the fluid analysis device being used for analysing said sample of fluid or the processed sample of fluid to generate data relating to a plurality of properties of said sample of fluid and communicating said data to a surface data processor or to at least one other subsea apparatus; and conveying means included in the housing for conveying the housing means from one subsea fluid flowline to another subsea fluid flowline or for conveying the housing to the surface.

The document EP 2 075 403 describes a system for the real-time analysis of multiphase fluids comprising: means for directing a fluid stream from a flow line to a fluid analysis module; a fluid analysis module comprising a sensor for measurement of at least one property of the fluid; a processor for processing the measurement data from the sensor; and communication means for communicating the processed data to a central acquisition unit or computer.

Such devices, systems and/or methods for preventing the formation of hydrates in a multi-phase fluid used a theoretical or experimental model in order to determine the hydrate formation range. This may not be satisfactory for the following reasons: the theoretical or experimental model may be uncorrelated with the actual conditions under which the multiphase fluid mixture is flowing into the main flow line; and it is a static evaluation of the transition that would cause a flow issue when occurring in the main flow line.

SUMMARY OF THE DISCLOSURE

It is an object of the invention to propose a predictive flow assurance assessment method and/or system that overcome one or more of the limitations of the existing methods and/or systems.

According to one aspect, there is provided a predictive flow assurance assessment method comprising:

- measuring at least one actual parameter related to a multiphase fluid mixture flowing in a main flow line;
- taking a sample from the multiphase fluid mixture flowing in the main flow line;
- modifying at least one control parameter of the sample until a transition appears, wherein said transition would cause a flow issue when occurring in the main flow line;
- detecting the transition of the sample and determining a corresponding transition value associated with the at least one control parameter;
- calculating a difference between the at least one actual parameter and the at least one transition value, said difference being representative of a margin relatively to a similar transition appearance in the main flow line causing a flow issue in the main flow line; and
- implementing a flow issue preventing step when the difference exceeds a given threshold.

The actual parameter and the control parameter may be chosen among the group of parameters comprising a temperature, a pressure, a density, a viscosity, and a quantity of a given compound in the multiphase fluid mixture.

The flow issue in the main flow line may be chosen among the group of flow issue comprising a solid compound deposition or precipitation causing a restriction or obstruction of the main flow line, a corrosion by a chemically active compound causing a weakening or leaking of the main flow line, a solid particles production causing an erosion or plugging of the main flow line, and an ice formation causing a clogging of the main flow line.

The flow issue preventing step may comprise adjusting the actual parameter related to the multiphase fluid mixture flowing in the main flow line until the difference is not below the given threshold.

The flow issue preventing step may comprise heating the multiphase fluid mixture flowing in the main flow line.

The flow issue preventing step may comprise injecting a chemical inhibitor product into the multiphase fluid mixture flowing in the main flow line.

According to a further aspect, there is provided a predictive flow assurance assessment system comprising:

- a first measuring module to measure at least one actual parameter related to a multiphase fluid mixture flowing in a main flow line;
- a sampling means to take a sample from the multiphase fluid mixture flowing in the main flow line;

a conditioning module to modify at least one control parameter of the sample until a transition appears, wherein said transition would cause a flow issue when occurring in the main flow line;

a second measuring module to detect the transition of the sample and determining a corresponding transition value associated with the at least one control parameter;

a processing module to calculate a difference between the at least one actual parameter and the at least one transition value, said difference being representative of a margin relatively to a similar transition appearance in the main flow line causing a flow issue in the main flow line; and a flow issue preventing module to implement a flow issue preventing step upon reception of a command from the processing module.

The sampling means, the conditioning module and the second measuring module may be integrated in a micro-analysis module.

The flow issue preventing module may comprise a plurality of injection module and a heating module.

The flow issue preventing module may be positioned upstream of the sampling means of the micro-analysis module.

The conditioning module may comprise a solid particles filter and an emulsion breaker, a phase separator for separating at least one phase sample from the multiphase fluid mixture, and at least one phase purification membrane.

The conditioning module may comprise at least one control parameter modification element associated with the at least one phase sample.

The second measuring module may comprise at least one sensor chosen among the group of sensors comprising a hydrogen sulphide H2S sensor, a carbon dioxide CO2 sensor, a density D sensor, a viscosity vr sensor, an infrared spectrometer iR, a pH sensor, a conductivity ρr sensor, an ultrasonic transducer, an optical sensor for detecting ice formation, a platinum sonde for measuring temperature, and a combination of the above.

With the invention, it is possible to induce a transition directly onto a sample representative of the multiphase fluid mixture flowing into the main flow line so as to determine the flow issue occurrence range. Thus, the predictive flow assurance assessment can be based on actual and representative flow issue occurrence range rather than, as proposed in the prior art, theoretical or experimental model uncorrelated with the actual conditions under which the multiphase fluid mixture is flowing into the main flow line. Further, this enables proposing a dynamic evaluation of the transition that would cause a flow issue when occurring in the main flow line rather than a static evaluation as proposed in the prior art.

Other advantages will become apparent from the hereinafter description of the invention.

BRIEF DESCRIPTION OF THE DRAWINGS

The present invention is illustrated by way of examples and not limited to the accompanying drawings, in which like references indicate similar elements.

DETAILED DESCRIPTION

Figure 1:
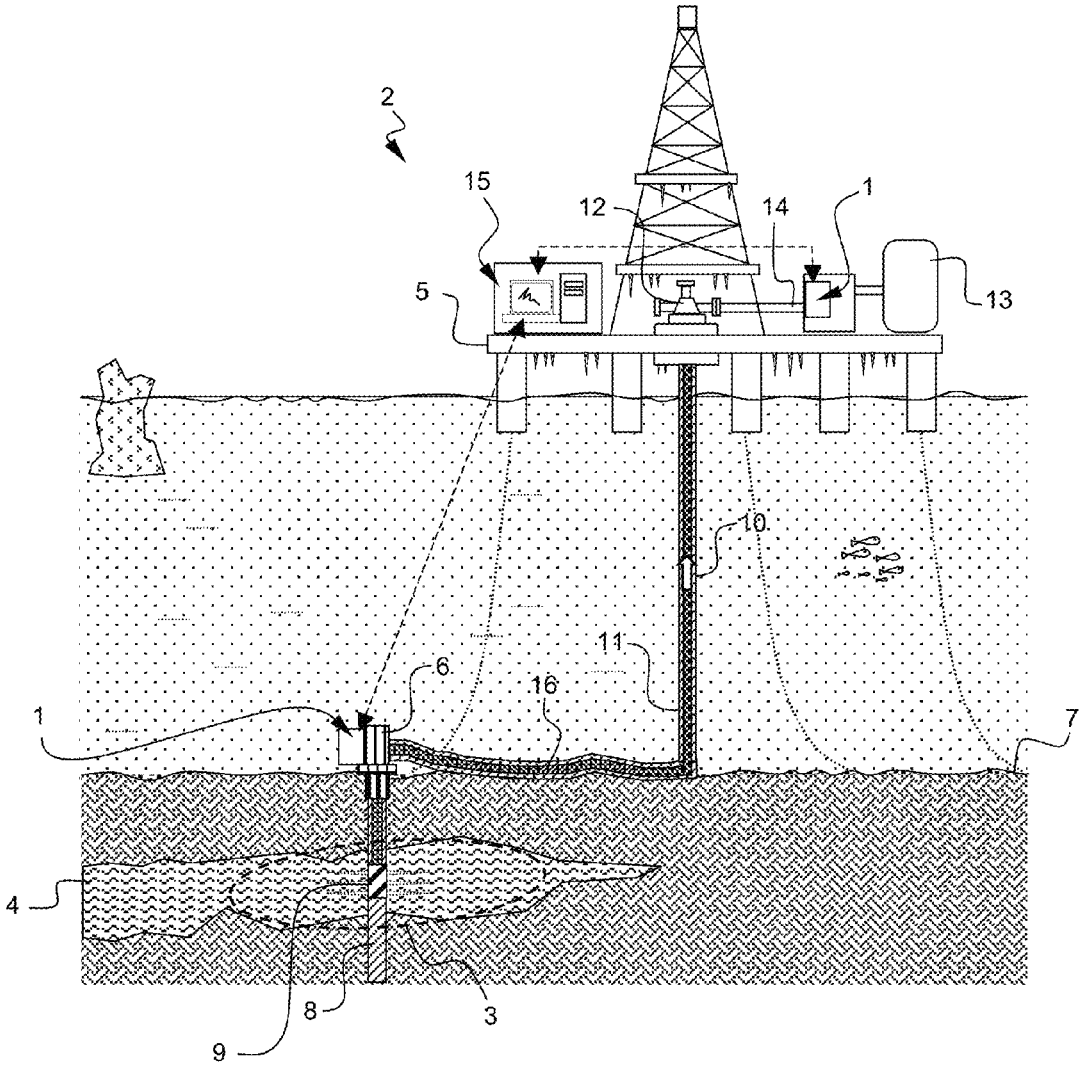
FIG. 1 schematically illustrates an offshore and subsea hydrocarbon well location and an installation for exploiting an oilfield reservoir, the installation comprising an embodiment of a predictive flow assurance assessment system according to one aspect of the invention.

In the oilfield domain of application, as illustrated in FIG. 1, offshore and subsea oil equipments 2 are positioned above a hydrocarbon-bearing and producing zone 3 of a hydrocarbon geological formation 4. The offshore and subsea oil equipments 2 may comprise a floating vessel or semisubmersible platform 5 located at the surface and a subsea well equipment 6 located on a seabed level 7. FIG. 1 depicts a well at a stage where it is producing hydrocarbon, e.g. oil and/or gas. The well bore is shown as comprising substantially vertical portion 8. However, it may also comprise horizontal or deviated portion (not shown).

Downhole, a producing section 9 of the well typically comprises perforations, production packers and production tubings at a depth corresponding to the hydrocarbon-bearing and producing zone 3 (i.e. a reservoir of the hydrocarbon geological formation 4). A multiphase fluid mixture 10 flows out of the hydrocarbon-bearing and producing zone 3, through the producing section 9, out of the well at the seabed level 7 through the subsea well equipment 6, along the seabed level 7 through a subsea flow line 16, and then towards the surface through a riser/production tubing 11 and then a well head 12. The well head 12 is coupled to surface production arrangement 13 by a surface flow line 14. The surface production arrangement 13 may comprise various elements coupled together. For example, the surface production arrangement 13 comprises a pressure reducer a pumping arrangement, a separator, a burner, a tank etc . . . (not shown in details). According to an embodiment, one or more predictive flow assurance assessment system 1 may be coupled at various location of the flow line between the hydrocarbon-bearing and producing zone 3 and the surface production arrangement 13. As examples, the predictive flow assurance assessment system 1 may be coupled to the flow line 11 at the level of the subsea well equipment 6, or at the level of the surface flow line 14, or any other position between the seabed level 7 and the floating vessel or semisubmersible platform 5.

The fluid mixture 10 is a multiphase fluid mixture. The terminology "multiphase fluid mixture" has a broad meaning in the oilfield domain of application. It is intended to comprise a broad range of hydrocarbon effluent compositions. Generally, it may be a mixture comprising a plurality of fluid fractions (water, oil, gas) and a plurality of constituting elements (water, various hydrocarbon molecules, impurities, $H_2S$, sand, etc . . . ). In term of fluid fractions, the composition of the mixture may vary in important proportion, for example from heavy oil and high water cut to high gas fraction. It may also be a mixture comprising a single phase in specific conditions, wherein the components constituting said phase may be separated. As examples, such conditions may be above the bubble point, or in non-isobaric or/and non-isothermal conditions. In such conditions, the single phase becomes biphasic and drops heavy components.

The predictive flow assurance assessment system 1 may be located where or close to a place where, in particular, temperature/pressure may vary in a great extend and where flow issues may occur. In particular, the large temperature and pressure drops from downhole/underground conditions (typical temperatures from 50 to 200° C. and pressures up to 2.000 bars) to sea floor conditions (temperatures approximately a few degrees only above 0° C.) generates transitions in the multiphase fluid mixture 10. Such conditions may cause flow assurance issues in subsea flow line and surface flow line, for example:

- solid compound deposition or precipitation causing a restriction or obstruction of the main flow line. As examples, this may be related to the formation of:
  - Hydrates
  - Wax or paraffins
  - Asphaltenes
  - Emulsions
  - Scale
- corrosion by a chemically active compound attacking the flow line made of steel materials and causing a leaking of the main flow line. As examples, this may be related to the presence of:
  - $H_2S$
  - $CO_2$
- solid particles production causing an erosion or plugging of the main flow line. As examples, this may be related to the formation of sand and/or other solid particles that may be present in geological formation; and
- ice formation causing a clogging of the main flow line.

A processing arrangement 15 is coupled to the predictive flow assurance assessment system 1. Further, it may also be coupled to other sensors at the surface or subsea or downhole (not shown). Furthermore, it may also be coupled to active completion devices like valves (not shown). The processing arrangement 15 may be positioned at the floating vessel or semisubmersible platform 5 located at the surface, or, alternatively, in the subsea well equipment 6 at the seabed level 7. The processing arrangement 15 may comprise a computer. It may be managed by an operator located on the floating vessel or semisubmersible platform 5. It may also be managed at a distance when the floating vessel or semisubmersible platform 5 is provided with a communication means, e.g. a satellite link (not shown) to transmit data to and receive instructions from an operator's office. The processing arrangement 15 may implement part of the predictive flow assurance assessment method. The processing arrangement 15 may also gather various measurements provided by various sensors related to the hydrocarbon-bearing and producing zone 3 and to the multiphase fluid mixture 10 at various locations of the well. From these measurements, the processing arrangement 15 may determine various information related to the multiphase fluid mixture 10, for example the total flow rate, the flow rates of the individual phases of the multiphase fluid mixture, the density of the multiphase fluid mixture, the temperature, the pressure and other parameters.

The precise design of the down-hole producing arrangement and surface production/processing arrangement is not germane to the present invention, and thus these arrangements are not described in details herein.

Figure 2:
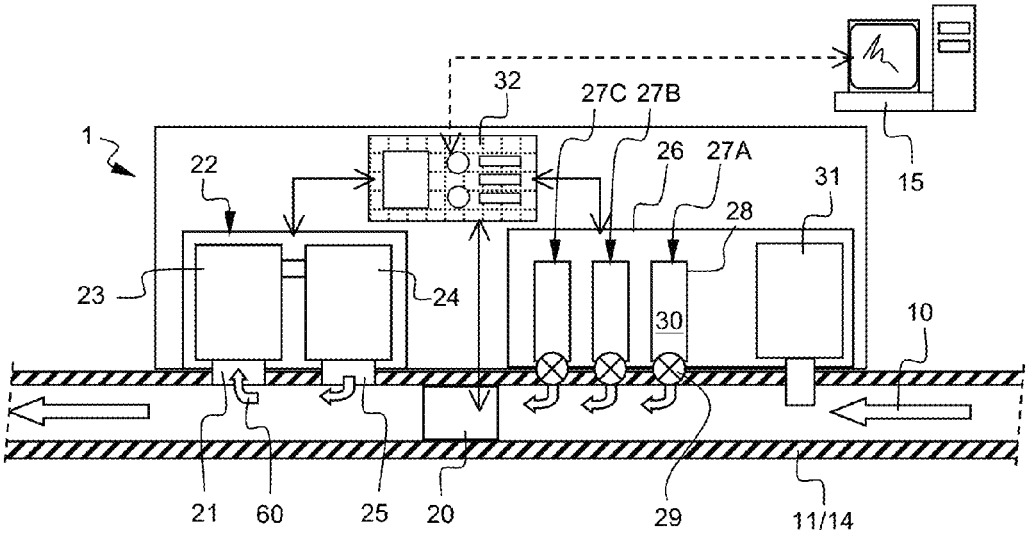
FIG. 2 schematically shows an embodiment of a predictive flow assurance assessment system according to one aspect of the invention.

FIG. 2 schematically shows an embodiment of the predictive flow assurance assessment system 1. The predictive flow assurance assessment system 1 comprises a first measuring module 20, a sampling means 21, a micro-analysis module 22, a discarding means 25, a flow issue preventing module 26 and a processing module 32.

The micro-analysis module 22 may comprise a conditioning module 23 and a second measuring module 24.

The flow issue preventing module 26 comprises a plurality of injection module, for example 27A, 27B and 27C, and a heating module 31. The heating module 31 comprises means for heating the multiphase fluid mixture. Each injection module comprises a container 28 and a valve 29. Each container (for example 28) is filled in with a chemical product (for example 30). As examples, the chemical product filled in the container of the injection module 27A, 27B and 27C may be:

- product for preventing hydrate formation, e.g. methanol or glycol based products;
- product for preventing asphaltene and paraffin precipitation, e.g. specific solids precipitation inhibitors like ethylene-vinyl acetate copolymer based product;
- product for preventing ice formation, e.g. glycol based product;
- product for adjusting the pH of the multiphase fluid mixture in order to prevent scales formation, e.g. acid or basic product;
- product comprising an anti-caking agent;
- product comprising a corrosion inhibitor; or
- product comprising a solvent; or
- a combination of at least two of the hereinbefore mentioned products.

The first measuring module 20 measures at least one actual parameter related to a multiphase fluid mixture 10 flowing in a main flow line 11 or 14. As an example, the first measuring module 20 may comprise a Venturi type multiphase flowmeter that measures pressure, temperature, and total flow rate of the multiphase fluid mixture. It may also be combined with a fraction meter, for example a gamma densitometer. A gamma densitometer comprising a gamma ray source and a gamma ray detector. The gamma densitometer measures absorption of the gamma ray by each phase of the multiphase fluid mixture and estimates a density of the multiphase fluid mixture and a fractional flow rate for each phase.

The sampling means 21 may comprise an inlet port and suction means. As an example, the suction means may be a pump or a Venturi restriction positioned downstream the inlet port so as to induce a suction effect of a sample part 60 of the multiphase fluid mixture 10 flowing in the main flow line 11 or 14. The suction effect may also be induced by other kind of arrangement, e.g. a V-cone, or an orifice plate.

The processing module 32 comprises a processor and memory. The processing module 32 is coupled to the micro-analysis module 22, the flow issue preventing module 26 and the first measuring module 20. Further, it may be coupled to the processing arrangement 15.

The flow issue preventing module 26 may be placed upstream of the sampling means 21 of the micro-analysis module 22, so that the effect of the flow issue preventing module, e.g. heating or injection of chemical product on the flow conditions may be continuously monitored. The micro-analysis module 22, the low issue preventing module 26 and the processing module 32 forms a feedback loop that enables optimizing the flow issues prevention strategy.

Figure 3:
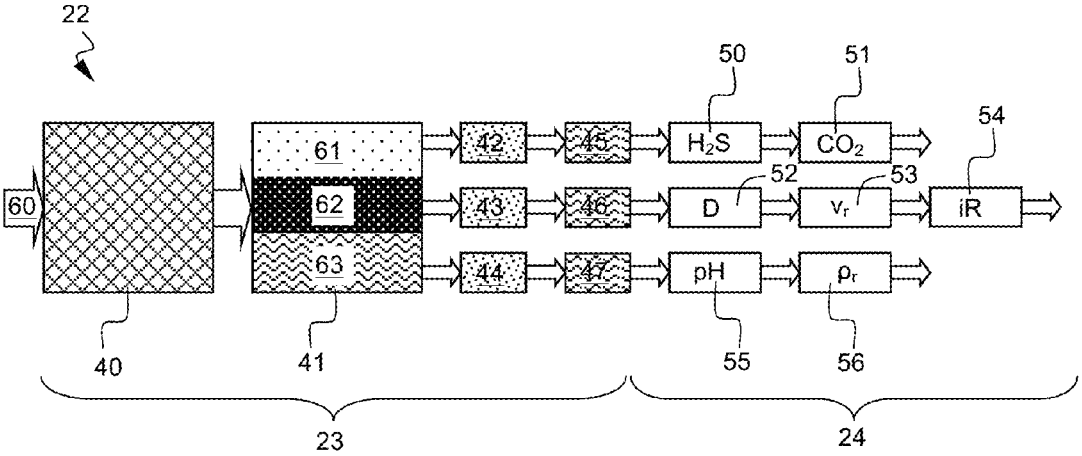
FIG. 3 schematically shows an embodiment of a micro-analysis module of the predictive flow assurance assessment system of FIG. 2.

FIG. 3 schematically shows an embodiment of a micro-analysis module 22 of the predictive flow assurance assessment system embodiment depicted in FIG. 2.

The conditioning module 23 may comprise a solid particles filter and an emulsion breaker 40, a phase separator 41, a gas purification membrane 42, an oil purification membrane 43 and a water purification membrane 44. The solid particles filter enables filtering out the sand present in the multiphase fluid mixture sample. The emulsion breaker enables providing an emulsion free multiphase fluid mixture.

The conditioning module 23 further comprises multiple control parameter modification elements 45, 46 and 47 associated with each phase sample, e.g. gas 61, oil 62 and water 63, respectively. As an example, the control parameter modification elements 45, 46 or 47 may comprise a Pelletier module or a cooler supplied with sea water in a controlled manner in order to control the temperature of each phase, and/or a pump in order to control the pressure of each phase.

The second measuring module 24 may comprise:

for analyzing the gas, a hydrogen sulphide $H_2S$ sensor 50 and a carbon dioxide $CO_2$ sensor 51;

for analyzing the oil, a density D sensor 52, a viscosity $v_r$ sensor 53 and an infrared spectrometer iR 54; and for analyzing the water, a pH sensor 55 and a conductivity $\rho_r$ sensor 56; and other specific sensors (not shown), for example ultrasonic transducer or optical sensor for detecting ice formation, platinum sonde for measuring temperature, etc. . . .

The control parameter modification elements 45, 46 or 47 enables modifying at least one control parameter of the phase sample 61, 62 and 63 until a transition detected by the various sensors of the second measuring module 24 appears.

The predictive flow assurance assessment system 1 is used to monitor continuously, in real-time or near real-time, and in-situ some properties representative of the actual multiphase fluid mixture 10 flowing in the main flow line 11 or 14, and also to controls the flow issue prevention operation.

Figure 4:
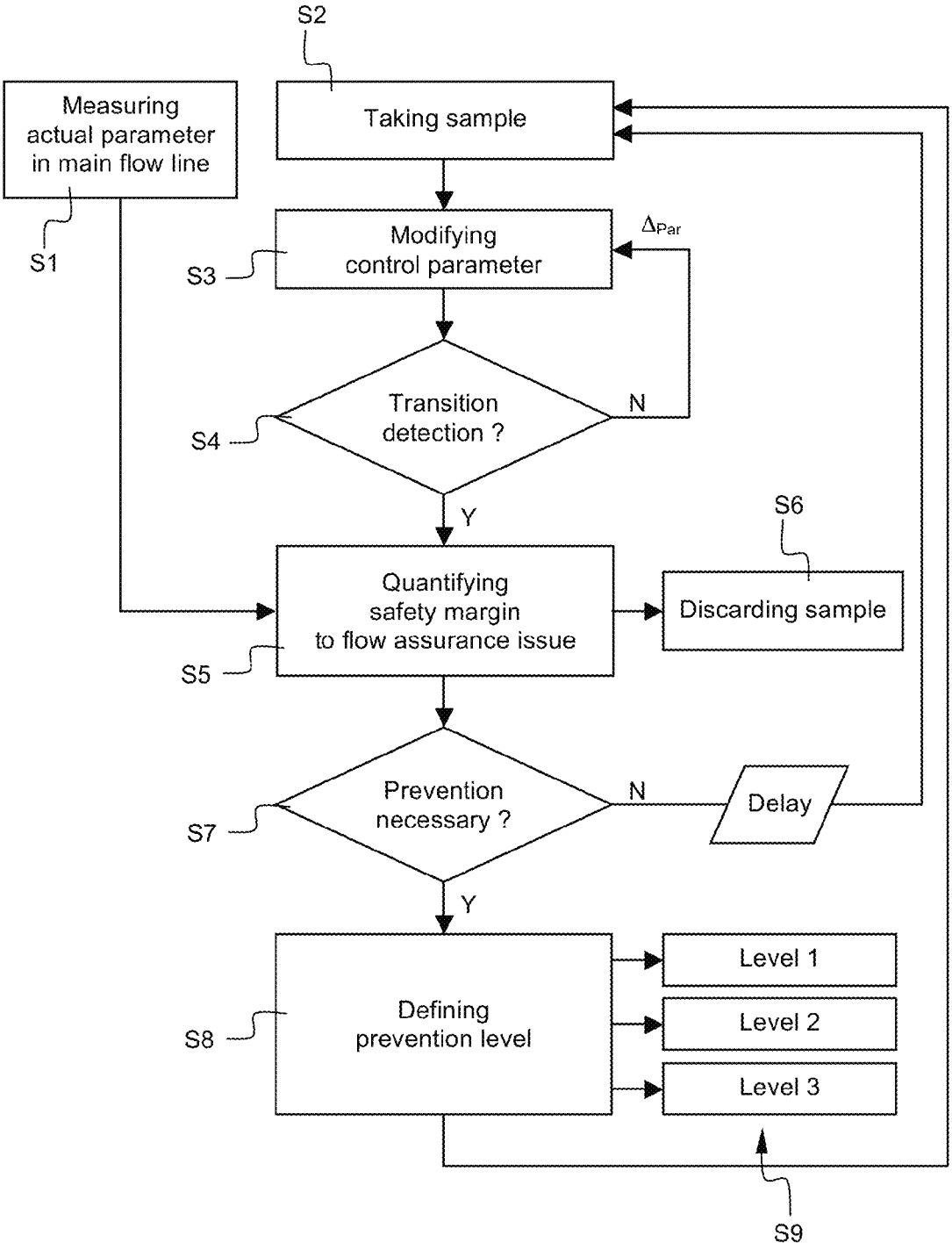
FIG. 4 schematically illustrates the principle of operation of the predictive flow assurance assessment system according to one aspect of the invention.

FIG. 4 schematically illustrates the principle of operation of the embodiment of the predictive flow assurance assessment system 1 depicted in FIGS. 2 and 3.

In a first step S1, at least one actual parameter related to the multiphase fluid mixture 10 flowing in the main flow line 11 or 14 is measured. Such a measurement may be performed on a continuous, real-time or near real-time basis.

In a second step S2, a fluid sample 60 is taken from the multiphase fluid mixture 10 flowing in the main flow line 11 or 14.

In a third step S3, at least one control parameter of the fluid sample 60 is modified until a transition appears. Such a transition would cause a flow issue when occurring in the main flow line.

In a fourth step S4, the transition of the sample is detected. A corresponding transition value associated with the at least one control parameter is determined accordingly. In case there is not any transition detected (branch N), the step S3 is repeated until a transition appears by successively modifying the at least one control parameter by a given delta ($\Delta_{Par}$).

In a fifth step S5 (branch Y), a difference between the at least one actual parameter and the at least one transition value is calculated. This difference is representative of a margin relatively to a similar transition appearance in the main flow line causing a flow issue in the main flow line 11 or 14.

Then, in a sixth step S6, the sample is discarded. The sample may be returned back to the main flow line 11 or 14.

In a seventh step S7, it is decided based on the calculated difference compared to a given threshold whether a flow issue preventing step may or may be not implemented. Potential problems of flow issue inside the main flow line are therefore anticipated before they happen and corrective actions can be effectively implemented.

In case the difference is below the given threshold (branch N), there is not any flow issue preventing step to be implemented. The second step S2 may be implemented once again. Optionally, the second step S2 may be implemented after a given delay. Optionally, the second step S2 may be implemented in a continuous manner.

In case the difference exceeds the given threshold (branch Y), a flow issue preventing step may be implemented.

In an eighth step S8, a prevention level may be defined based on the value of said difference, or the nature of control parameter.

In a ninth step S9, various prevention level, for example a first level (Level 1), a second level (Level 2), a third level (Level 3), etc . . . may be implemented based on the control parameter that is actually taken under consideration. As an example, the first level may comprise heating the multiphase fluid mixture, the second level may comprise injecting an appropriate chemical product, and the third level may comprise a combination of the hereinbefore mentioned actions. Other prevention levels may be defined, for example controlling various chokes (not shown) of the installation in order to modify the pressure within the main flow line. This may be implemented through the processing arrangement 15 at the surface.

Then, the second step S2 is repeated. Thus, the effect of flow issue prevention can be directly monitored. This provides an increased safety margin after the preventing step(s) is(are) implemented. By using this approach, the risks of flow interruption are avoided, at least greatly reduced. Further, the type and quantity of chemical products to be injected are optimized. This results in very cost effective way of preventing flow issues.

The drawings and their description hereinbefore illustrate rather than limit the invention.

It should be appreciated that embodiments of the present invention are not limited to offshore hydrocarbon wells and can also be used onshore hydrocarbon wells. Furthermore, although some embodiments have drawings showing a vertical well bore, said embodiments may also apply to a horizontal or deviated well bore. All the embodiments of the present invention are equally applicable to cased and uncased borehole (open hole).

Although a drawing shows different functional entities as different blocks, this by no means excludes implementations in which a single entity carries out several functions, or in which several entities carry out a single function. In this respect, the drawings are very diagrammatic. The functions of the various elements shown in the FIGS., including any functional blocks, may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "entity" should not be construed to refer exclusively to hardware capable of executing software, and may implicitly include, without limitation, digital signal processor (DSP) hardware, processor, application specific integrated circuit (ASIC), field programmable gate array (FPGA), read only memory (ROM) for storing software, random access memory (RAM), and non volatile storage. Other hardware, conventional and/or custom, may also be included.

It should be appreciated by those skilled in the art that any block diagrams herein represent conceptual views of illustrative elements embodying the principles of the invention. Further, the appended drawings are not intended to be drawn to scale.

The method and system of the present disclosure may be applied in various industries, for example the oilfield industry, the chemical industry, the aerospace industry, etc. . . .

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. A predictive flow assurance assessment method comprising:

measuring at least one actual parameter related to a multiphase fluid mixture flowing in a main flow line; and taking a sample from the multiphase fluid mixture flowing in the main flow line;

modifying at least one control parameter of the sample until a transition appears, wherein said transition would cause a flow issue when occurring in the main flow line;

detecting the transition of the sample and determining a corresponding transition value associated with the at least one control parameter;

wherein the method further comprises:

calculating a difference between the at least one actual parameter and the at least one transition value, said difference being representative of a margin relatively to a similar transition appearance in the main flow line causing a flow issue in the main flow line; and implementing a flow issue preventing step when the difference exceeds a given threshold.

2. The predictive flow assurance assessment method of claim 1, wherein the actual parameter and the control parameter are chosen among the group of parameters comprising a temperature, a pressure, a density, a viscosity, and a quantity of a given compound in the multiphase fluid mixture.

3. The predictive flow assurance assessment method of claim 1, wherein the flow issue in the main flow line is chosen among the group of flow issue comprising a solid compound deposition or precipitation causing a restriction or obstruction of the main flow line, a corrosion by a chemically active compound causing a weakening or a leaking of the main flow line, a solid particles production causing an erosion or plugging of the main flow line, and an ice formation causing a clogging of the main flow line.

4. The predictive flow assurance assessment method of claim 1, wherein the flow issue preventing step comprises adjusting the actual parameter related to the multiphase fluid mixture flowing in the main flow line until the difference is not below the given threshold.

5. The predictive flow assurance assessment method of claim 1, wherein the flow issue preventing step comprises heating the multiphase fluid mixture flowing in the main flow line.

6. The predictive flow assurance assessment method of claim 1, wherein the flow issue preventing step comprises injecting a chemical inhibitor product into the multiphase fluid mixture flowing in the main flow line.

7. A predictive flow assurance assessment system comprising:

a first measuring module to measure at least one actual parameter related to a multiphase fluid mixture flowing in a main flow line;

a sampling means to take a sample from the multiphase fluid mixture flowing in the main flow line;

a conditioning module to modify at least one control parameter of the sample until a transition appears, wherein said transition would cause a flow issue when occurring in the main flow line;

a second measuring module to detect the transition of the sample and determining a corresponding transition value associated with the at least one control parameter;

a flow issue preventing module to implement a flow issue preventing step upon reception of a command from a processing module;

wherein the system further comprises:

the processing module is arranged to calculate a difference between the at least one actual parameter and the at least one transition value, said difference being representative of a margin relatively to a similar transition appearance in the main flow line causing a flow issue in the main flow line and to send a command to the flow issue preventing module when the difference exceeds a given threshold.

8. The predictive flow assurance assessment system of claim 7, wherein the sampling means, the conditioning module and the second measuring module are integrated in a micro-analysis module.

9. The predictive flow assurance assessment system of claim 7, wherein the flow issue preventing module comprises a plurality of injection module and a heating module.

10. The predictive flow assurance assessment system of claim 7, wherein the flow issue preventing module is positioned upstream of the sampling means of the micro-analysis module.

11. The predictive flow assurance assessment system of claim 7, wherein the conditioning module comprises a solid particles filter and an emulsion breaker, a phase separator for separating at least one phase sample from the multiphase fluid mixture, and at least one phase purification membrane.

12. The predictive flow assurance assessment system of claim 7, wherein the conditioning module comprises at least one control parameter modification element associated with the at least one phase sample.

13. The predictive flow assurance assessment system of claim 7, wherein the second measuring module comprises at least one sensor chosen among the group of sensors comprising a hydrogen sulphide H2S sensor, a carbon dioxide CO2 sensor, a density D sensor, a viscosity vr sensor, an infrared spectrometer iR, a pH sensor, a conductivity pr sensor, an ultrasonic transducer, an optical sensor for detecting ice formation, a platinum sonde for measuring temperature, and a combination of the above.

* * * * *